US010053866B2

(12) United States Patent
Weeks et al.

(10) Patent No.: US 10,053,866 B2
(45) Date of Patent: Aug. 21, 2018

(54) ROOFING BATTEN

(71) Applicant: Weeks Holdings Pty Ltd, Edinburgh North, South Australia (AU)

(72) Inventors: Kevin William Weeks, Edinburgh North (AU); Daniele James Strangio, Edinburgh North (AU); Shane Dudley Voigt, Edinburgh North (AU); Dominic Sean Gillespie, Castle Hill (AU)

(73) Assignee: Weeks Holdings Pty Ltd (AU)

( * ) Notice: Subject to any disclaimer, the term of this patent is extended or adjusted under 35 U.S.C. 154(b) by 0 days.

(21) Appl. No.: 15/607,758

(22) Filed: May 30, 2017

(65) Prior Publication Data

US 2017/0342715 A1 Nov. 30, 2017

(30) Foreign Application Priority Data

May 30, 2016 (AU) ..... 2016902050

(51) Int. Cl.

| | |
|---|---|
| ***E04D 1/00*** | (2006.01) |
| ***E04D 12/00*** | (2006.01) |
| ***E04D 13/16*** | (2006.01) |
| ***E04D 3/366*** | (2006.01) |
| *E04D 13/00* | (2006.01) |

(52) U.S. Cl.

CPC ..... *E04D 12/004* (2013.01); *E04D 3/366* (2013.01); *E04D 12/00* (2013.01); *E04D 13/1618* (2013.01); *E04D 13/00* (2013.01); *E04D 13/16* (2013.01)

(58) Field of Classification Search

CPC ..... E04D 12/004; E04D 3/366; E04D 12/00; E04D 13/1618; E04D 1/34; E04D 3/30; E04D 13/1625; E04D 3/365; E04B 7/024; E04B 9/22; E04B 1/24; E04B 1/82; E04B 13/7409; E04B 2/7412; E04B 9/001; E04B 2001/8272

USPC ..... 52/553

See application file for complete search history.

(56) References Cited

U.S. PATENT DOCUMENTS

| | | | | | |
|---|---|---|---|---|---|
| 1,459,855 | A * | 6/1923 | Olden | E04D 3/365 | 52/521 |
| 2,124,830 | A * | 7/1938 | Roth | E04D 3/365 | 52/521 |
| 3,073,021 | A * | 1/1963 | Goodwill | B21D 5/08 | 72/177 |
| 3,852,933 | A * | 12/1974 | Guzzo | E04D 3/365 | 52/520 |

(Continued)

*Primary Examiner* — Brian D Mattei

(74) *Attorney, Agent, or Firm* — Craig A. Fieschko, Esq.; DeWitt Ross & Stevens S.C.

(57) ABSTRACT

A batten for use in roofing applications is defined by an upside-down U-shaped channel with outwardly projecting horizontal flanges. In certain versions, the legs forming the sides of the channel are asymmetrical to allow vertical orientation of at least one of the legs when installed on an angled roof. This improves strength and load bearing of the installed member, and allows it to provide a fall barrier for roof installers. In certain versions, one of the flanges has a ribbed impact reduction zone. This zone deforms when a building anchor, such as a nail, passes through it to anchor the member to a roof. The deformation prevents anchors fired from conventional equipment from passing completely through the member and holds the anchors more securely in place.

27 Claims, 4 Drawing Sheets

(56) References Cited

U.S. PATENT DOCUMENTS

| | | | | |
|---|---|---|---|---|
| 4,099,357 | A * | 7/1978 | Lester | E04D 3/365 52/533 |
| 4,133,161 | A * | 1/1979 | Lester | E04D 3/365 52/521 |
| 4,959,939 | A * | 10/1990 | Buchanan, Jr. | E04D 3/366 52/462 |
| 7,191,570 | B1 * | 3/2007 | Eaton | E04B 9/22 52/465 |
| 7,797,905 | B1 * | 9/2010 | Smalley | E04L 37/024 52/478 |
| 2003/0029126 | A1 * | 2/2003 | Wetzel, III | E04L 31/34315 52/716.8 |
| 2005/0210825 | A1 * | 9/2005 | Peleg | E04D 3/30 52/748.1 |
| 2005/0271467 | A1 * | 12/2005 | Ong | E02D 5/08 403/359.1 |
| 2009/0126315 | A1 * | 5/2009 | Knauf | E04C 3/07 52/846 |
| 2009/0283359 | A1 * | 11/2009 | Ravnaas | E04B 1/82 181/286 |
| 2011/0146180 | A1 * | 6/2011 | Klein | E04L 32/7409 52/317 |

* cited by examiner

ROOFING BATTEN

FIELD OF THE INVENTION

This document relates generally to a building element, namely a batten used in the building of roofs, and in particular a batten made of rolled steel (or other metal) that may be used with steel (or other metal) or wooden roof trusses.

BACKGROUND OF THE INVENTION

Battens, or purlins, are long, thin, and flat pieces of building material that are attached to the roof trusses to which the roofing material is fixed.

In a wooden framed structure, the (often wooden) battens are traditionally square or rectangular in cross-section. In a steel framed structure, traditionally the (typically metal) battens each have the shape of a generally U-shaped channel with outwardly extending flanges, wherein each batten is installed inverted (with the channel of the "U" facing downwardly), and with the flanges screwed or otherwise attached to the roof trusses. The roofing material may then be affixed to the tops of the battens (the generally flat bases of the "U" shape). These battens are often referred to as "top hats". Top hats may be of different heights and widths, and the ratio between height and width may vary, but they are generally symmetrical.

Both top hats and wooden battens are used with both roof tiles and sheet roofing such as corrugated metal roofs. Sheet roofing is generally much lighter than tiles, and its span is much greater than a tile. A tile generally is between 300 mm and 450 mm long, and each row of tiles must be supported by a batten, so the battens are spaced 300 mm to 450 mm apart. A piece of sheet roofing can be of almost any length, and the battens may be spaced at 1200 mm and still provide a strong base for the roof. As a result, many less battens are required to make a roof covered with sheet material than tiles. Therefore tiled roofs are much more expensive than roofs of sheet material, not only from the cost of tiles, but the cost of battens and the time taken to install so many more battens.

Most tiles have a lower lip which hooks over the batten and then the tile is nailed to the batten, either through the lip or from the top.

Wooden battens, due to the thickness of the wood, are not very strong and cannot hold the weight of a roof installer. Working at height to install a roof means that there is always the risk of falling. Anything that can be done to minimise the spaces through which a roof installer can fall is desirable.

A steel batten is much stronger than a wood batten and can help support the weight of a worker. (Where this document refers to steel battens, it should be understood that while steel is preferred, other metals or appropriate plastics might be used instead.) When steel battens are installed at a spacing of between 300 and 450 mm, if a worker were to slip, the battens would form a safety net and prevent the worker from falling to the ground.

Wooden battens can warp and have weak spots. Steel battens do not warp or suffer from weak spots. However, the strength of a steel batten can be affected by the shape of the cross section, how it is installed, and the thickness of the steel used. Steel battens or top hats may be overlapped at joins due to their shape, providing extra strength. Wooden battens cannot be overlapped as the roof would then have ridges.

Also, traditional steel battens have not been used with timber trusses and tiled roofs due to higher costs and changes in work practices being required.

However, wooden battens can be attached to the roof with a nail gun, and with the same nails used to build the roof trusses and the rest of the building frame. For many reasons workers are reluctant to carry too many tools. They are also reluctant, and it is inefficient, to have to exchange tools for different jobs. Ideally, a steel batten would be installable using a standard nail gun. However, due to the thickness of the material used to make steel battens, a nail gun will blow a nail right through a steel batten, and won't affix the batten to the truss below. This applies if the nail is inserted through the horizontal top of the top hat, or the flanges of the top hat. Additionally, traditional top hats also have narrow flanges which do not allow the application of a nail gun at an appropriate angle, limiting the ways in which the batten may be installed.

Typically, steel battens have been more expensive than timber battens due to the material used and the working required. Usually a steel batten is made from 0.55 mm steel. This provides a steel batten strong enough to hold the weight of any roofing material as well as providing a fall barrier when installed on the roof trusses. However, at current prices, a typical steel batten cannot compete cost-wise with wooden battens. Even the improvements in strength and worker safety do not make a standard steel batten competitive with a wooden batten.

SUMMARY OF THE INVENTION

The invention seeks to provide an improved steel batten which provides at least the same strength as the traditional steel batten made from 0.55 mm steel, but uses less steel to do so, providing cost and environmental benefits. The invention also seeks to provide a steel batten which can be used on wooden structures to overcome the safety, strength, and uniformity issues associated with wooden battens. Additionally, it would be advantageous if such a solution avoided increased expense or the changes in work practices required by using a traditional steel batten on wooden trusses. The batten must also meet building standards for strength of a steel batten.

The steel batten is preferably made from thinner steel, or uses a narrower width of steel. There are limits on minimum heights and widths for a batten to be useful. The most preferred version of the invention seeks to provide the desired strength not by merely altering the thickness of material, but by changing the design and shape of the batten. However, slightly different dimensions may result in an essentially similar shape and strength if a different thickness of steel is employed. Furthermore, the invention is not limited by the thickness of the material used. The thicker the material used, the stronger the batten of the invention.

A preferred version of the invention involves a batten formed by an upside-down U-shaped channel with outwardly projecting horizontal flanges. In certain versions of the invention, the legs forming the sides of the channel are asymmetrical to allow vertical orientation of at least one of the legs when installed on an angled roof. This improves strength and load bearing of the installed member, even if it does not use conventional 0.55 mm steel, and allows it to provide a fall barrier for the roof installers. In certain versions of the invention, one of the flanges has a ribbed impact reduction zone. This zone deforms when a building anchor, such as a nail, passes through it to anchor the member to a roof. The deformation prevents anchors fired from conventional equipment, such as a nail gun, from passing completely through the member and holds them in place more securely.

BRIEF DESCRIPTION OF DRAWINGS

Exemplary versions of the invention will be discussed with reference to the accompanying drawings wherein.

In the following description, like reference characters designate like or corresponding parts throughout the figures.

DETAILED DESCRIPTION OF EXEMPLARY VERSIONS OF THE INVENTION

Figure 1:
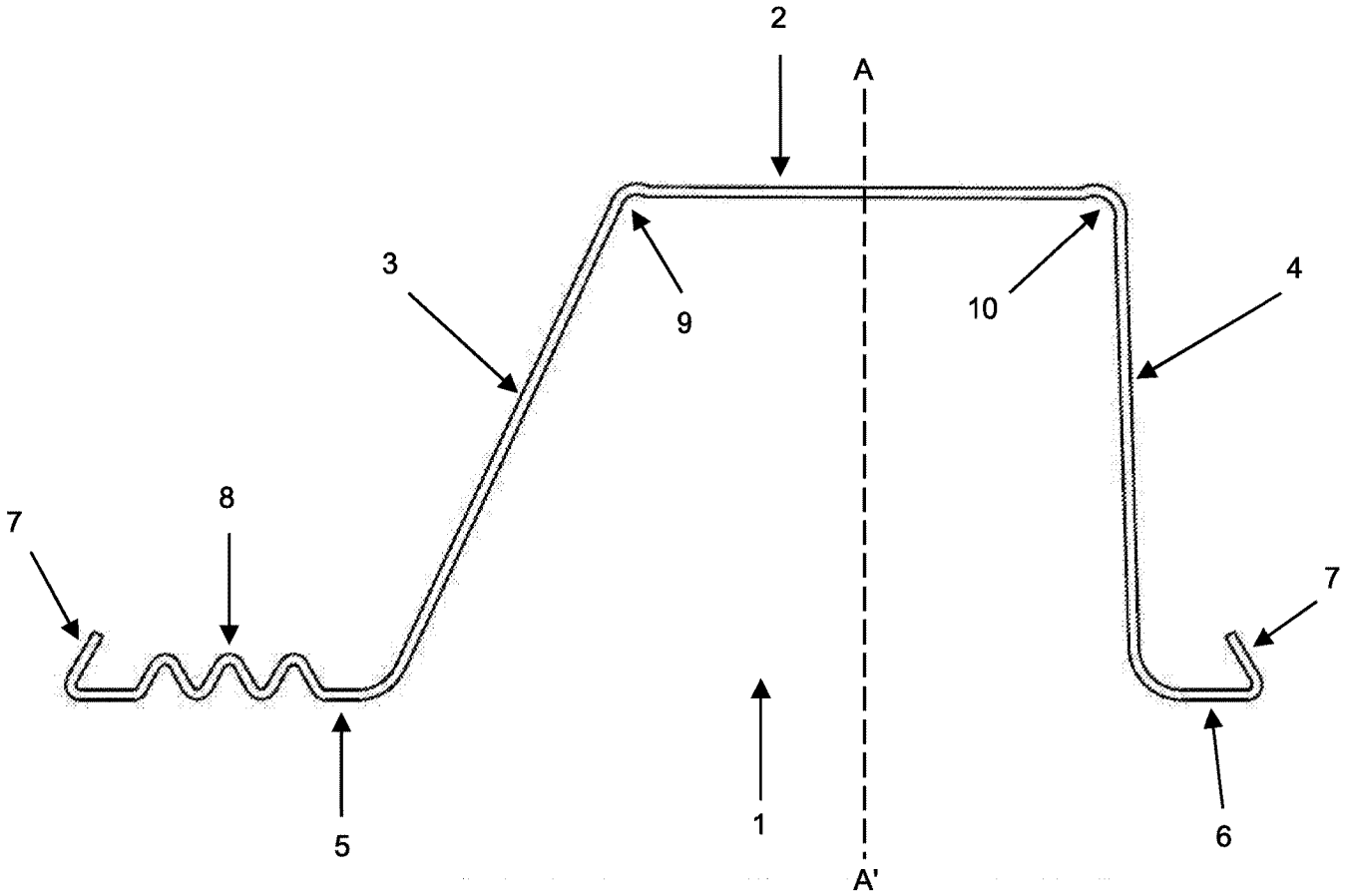
FIG. 1 is a cross-sectional view of a preferred version of the invention.
Figure 2:
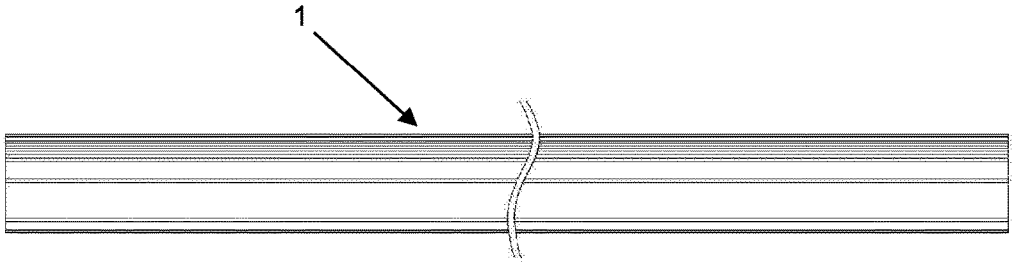
FIG. 2 is a top view of a preferred version of the invention.
Figure 3:
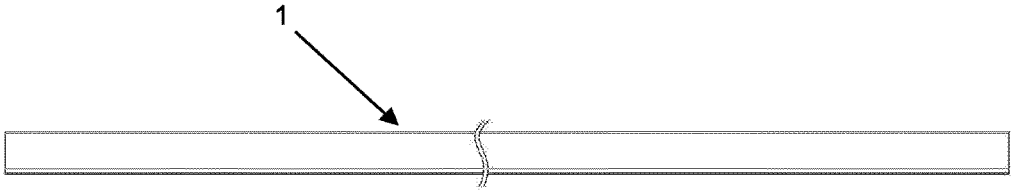
FIG. 3 is a left-hand side view of a preferred version of the invention.
Figure 4:
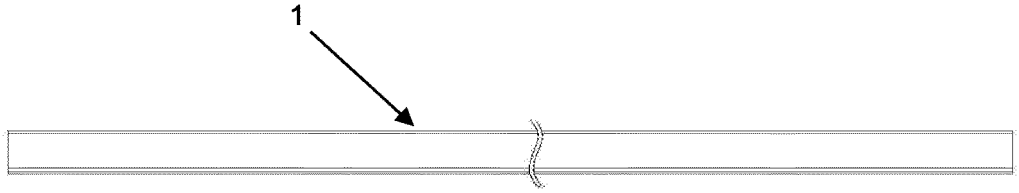
FIG. 4 is a right-hand side view of a preferred version of the invention.
Figure 5:
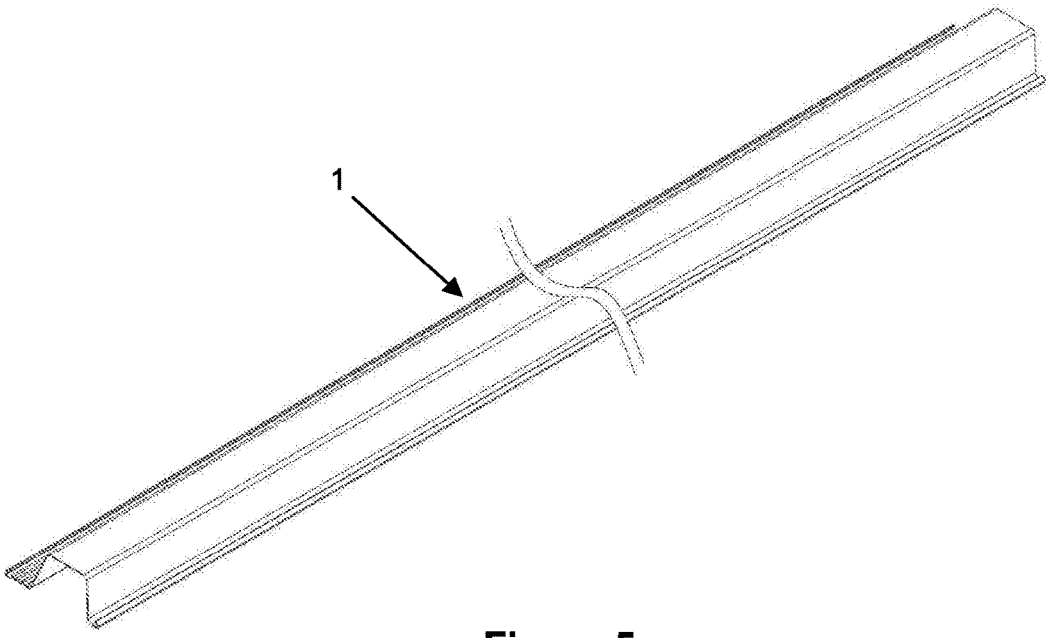
FIG. 5 is a perspective view of a preferred version of the invention.
Figure 6:
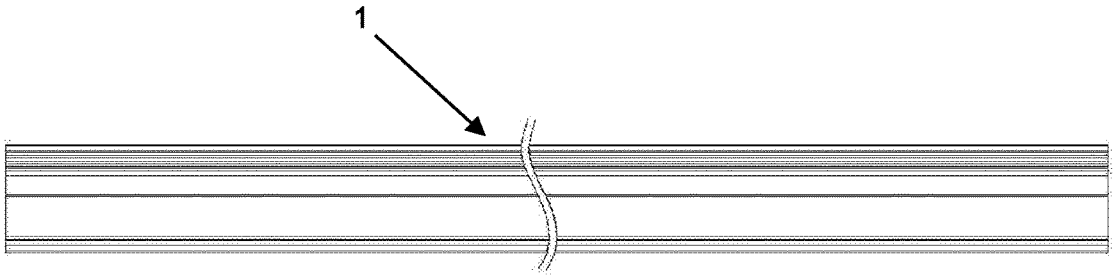
FIG. 6 is a bottom view of a preferred version of the invention.

Referring to FIG. 1, a batten 1 has a horizontal top 2 connecting a first leg 3 and a second leg 4, resulting in a channel with an upside-down U-shaped cross-section. First leg 3 is at a first internal angle 9 to horizontal top 2, while second leg 4 is at a second internal angle 10 to horizontal top 2. Flange 5 extends substantially horizontally outward from the end of first leg 3 opposite horizontal top 2. Flange 6 extends substantially horizontally outward from the end of second leg 4 opposite horizontal top 2. Flanges 5 and 6 also feature turn ups 7 at their free ends. FIG. 1 also shows a vertical axis of batten 1 extending from A to A'.

A preferred version of the invention utilizes a first inclined leg 3 and a second substantially vertical leg 4. Another preferred version of the invention utilizes a ribbed flange 5 and a flat flange 6, with ribbed flange 5 featuring an impact reduction zone 8.

The preferred version of the invention is made of steel. In certain versions of the invention, the steel is a light gauge steel (i.e., thinner than 24 gauge). In certain versions of the invention, first internal angle 9 is an angle of at least 105° or at least 115° with horizontal top 2. Second internal angle 10 is an angle of at least 92° with horizontal top 2. In certain versions of the invention, the total height of batten 1 is no more than approximately 25 mm and the total width of batten 1 is no more than approximately 60 mm.

In one preferred version of the invention, shown in FIGS. 1 through 6, batten 1 is asymmetrical about the vertical axis, i.e., each of the legs has a different length and angle to the other. The specific lengths of horizontal top 2, inclined leg 3, and substantially vertical leg 4 can be altered, but the asymmetrical nature of batten 1 of the invention is preferred. The asymmetric shape allows attachment of batten 1 with flange 5 on the lower side of batten 1 to align the substantially vertical leg 4 to a position that is optimal for engagement with a roof tile. A top downwardly extending lip of the roof tile engages substantially vertical leg 4 in such a way that the tile can then be easily, permanently attached to batten 1. Batten 1 provides a smooth surface over which the tile lip can be hooked, allowing the tile to stay in place until anchored to batten 1.

The asymmetric shape also means that when installed to angled roof members, such as wooden or steel trusses on a pitched roof, both legs of batten 1 end up being almost vertical with respect to the ground. This aligns both legs with the direction of gravity and helps to provide improved strength and load bearing. As a result, batten 1 is strong enough to provide a fall barrier for roof installers. Typical roofs have a pitch of approximately 15-30°; during installation, when the shorter side (substantially vertical leg 4) is placed on the higher side of the roof, the longer side (inclined leg 3) will be close to vertical. This compares to traditional battens where the legs are of the same length and at the same angle to the horizontal top.

The improved strength of batten 1 means it can be used as a batten or top hat on any roof member, spaced appropriately for any roofing material, such as, but not limited to, tiles or sheet metal, and still provide a fall barrier for the roofing contractors or a place to stand while the roofing material is installed. The strength of batten 1 means it is strong enough to meet all appropriate standards for roofing battens and can carry the loads of roofing material, even the heavy weight of a concrete tile roof.

The exact internal angles and length of the legs may be adjusted to optimize the alignment of the longer leg for different roof pitches. The cost of retooling the roll forming machine that makes the battens may increase expenses, but if a manufacturer always made roofs with the same pitch, the variations could be worked out to provide the optimal arrangement for that roof pitch. The values used in the version shown are most useful for roofs with pitches of 20-30°, which are common in Australia, but could be customized to roof pitches ranging from 4° to 55°.

Other preferred versions of the invention with ribbed flange 5, as shown in FIGS. 1 through 6, allow batten 1 to be installed on the wooden roof trusses using a standard building anchor, such as a nail projected from a nail gun. Ribbed flange 5 incorporates at least two ribs; the preferred version of batten 1 has three ribs. The width of ribbed flange 5 can be altered, but is preferably wide enough to allow a nail gun to be placed in such a way to insert a nail. Ribbed flange 5 also has turn up 7 of at least 90° at its distal end. The preferred version has a turn up 7 of at least 110°.

The ribbing (which may also be called rippling, striations, ridges or undulations) strengthens the material of batten 1 and helps to keep the building anchor in batten 1. The ribbing also forms impact reduction zone 8, allowing the energy in a projected building anchor to be dissipated or absorbed and thereby reducing its impact. As a result, the installers may not need to have extra tools or significantly adjust or alter their standard tools and practices of the trade. Furthermore, the force of the building anchor being installed deforms the ribs in such a way that the material folds over and covers the head of the building anchor, holding the building anchor more securely and strongly in a recess, and aiding the connection between building anchor, batten, and roof member.

The added feature of ribbed flange 5 means batten 1 can be easily installed on either a steel or wooden frame set of roof members, such as trusses. When it is used on wooden framed roof trusses, roofing contractors do not need to change equipment or alter their roofing practices. As one example, a nail gun can still be used to attach batten 1, and the nail will not pass through the material of flange 5 of batten 1.

In versions of batten 1 using ribbed flange 5, flat flange 6 has no ribs and is not as wide as ribbed flange 5. Flat flange 6 also has turn up 7 of at least 90° at its distal end. The preferred version has a turn up 7 of at least 110°.

Figure 7:
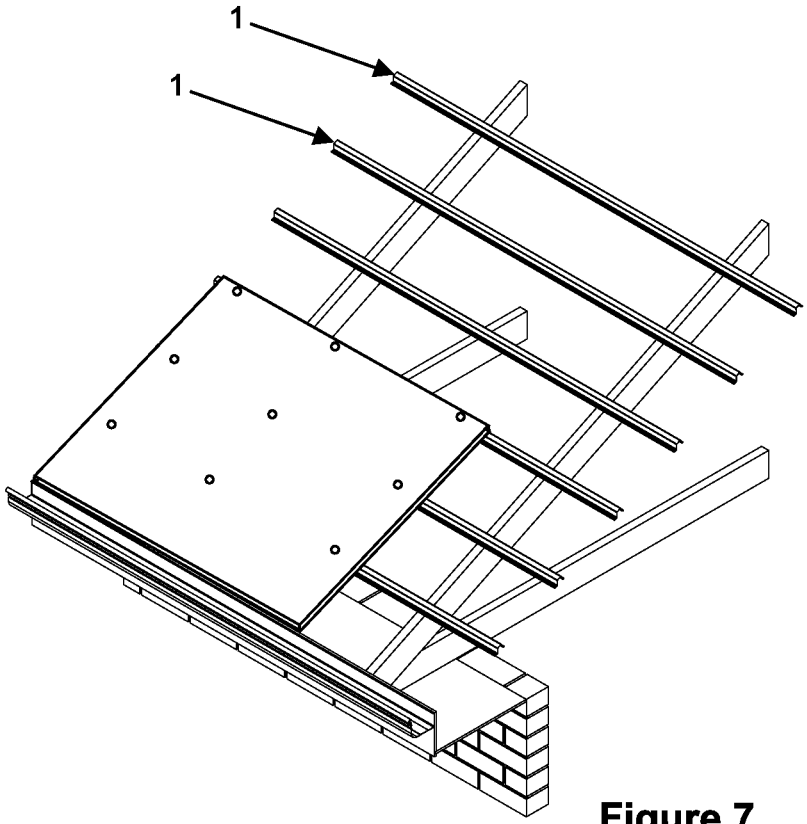
FIG. 7 is a perspective view of a preferred version of the invention installed as part of a pitched roof.

As shown in FIG. 7, during installation a user would place batten 1 on top of at least one roof member, such as, but not limited to, a truss. If batten was asymmetrical and the roof member an angled roof member, the user would orient the batten such that the substantially vertical leg was located further up the angled roof member. The user would then project at least one building anchor, such as a nail from a nail gun, partially through flange 5 and into the roof member to connect the roof member and batten 1. If batten 1 included impact reduction zone 8 with deformable ribs, the user would project the building anchor partially through impact reduction zone 8 such that the building anchor deformed at least one of the deformable ribs. Once batten 1 was secured, the user could cover batten 1 with roofing material, such as sheet metal or roofing tile, and project at least one additional building anchor partially through the roofing material and into the horizontal top to secure the roofing material to batten 1.

Batten 1 of the invention may also be useful in other areas. Batten 1 may be useful for being a support for solar panels, satellite dishes, or other objects mounted on roofs. Any version of batten 1 may also be part of a roof system including at least one roof member, and at least one building anchor partially extending through flange 5 and into the roof member to connect the roof member and batten 1. The building anchor may be a nail from a nail gun, while the roof member may be an angled truss, or a wooden or steel roof member.

Throughout this document, unless the context requires otherwise, the words "include" and "including" (and variations such as "comprise" and "comprising") will be understood to include the stated element (or group of elements), as well as additional instances of the stated element (or group of elements).

It should also be understood that various terms referring to orientation and position used throughout this document—e.g., "horizontal top"—are relative terms rather than absolute ones. In other words, it should be understood (for example) that the horizontal top referred to may in fact be located at a non-horizontal angle, or at the bottom of the batten, depending on the overall orientation of the apparatus. Thus, such terms should be regarded as words of convenience, rather than limiting terms.

Where a measurement or other value is qualified by the term "approximately," "about," or like terms—for example, "approximately 50 mm"—this can be regarded as referring to a variation of 10% from the noted value. Thus, "about 50 mm" can be understood to mean between 45 and 55 mm.

The versions of the invention described above are merely exemplary, and the invention is not intended to be limited to these versions. Rather, the scope of rights to the invention is limited only by the claims set out below, and the invention encompasses all different versions that fall literally or equivalently within the scope of these claims.

The invention claimed is:

1. A batten including:

a. a channel having an upside-down U-shaped cross-section, the channel including:

(1) a horizontal top, (2) an inclined first leg connected to the horizontal top at a first internal angle, the and (3) a substantially vertical second leg connected to the horizontal top at a second internal angle, the second leg being shorter than the first leg, whereby the channel is asymmetrical about a vertical axis;

b. a first flange:

(1) extending horizontally outwardly from an end of the first leg opposite the horizontal top to a free end, and (2) including an impact reduction zone having multiple deformable ribs located between the first leg and the free end;

c. a second flange extending horizontally outwardly from an end of the second leg opposite the horizontal top;

d. a roof member; and e. a building anchor extending through the first flange and into the roof member, thereby connecting the roof member and the batten.

2. The batten of claim 1 wherein the batten is steel.

3. The batten of claim 2 wherein the steel has a gauge thinner than 24 gauge.

4. The batten of claim 1 wherein:

a. the first flange has a turn up of at least 90° at its free end, and b. the second flange has a turn up of at least 90° at its free end.

5. The batten of claim 1 wherein the batten has:

a. a height of no more than approximately 25 mm, and b. a width of no more than approximately 60 mm.

6. The batten of claim 1 wherein the first internal angle is at least 105°.

7. The batten of claim 1 wherein the first internal angle is at least 115°.

8. The batten of claim 1 wherein the second internal angle is at least 92°.

9. The batten of claim 1 wherein:

a. the first flange is a ribbed flange, and b. the second flange is a flat flange.

10. The batten of claim 9 wherein the ribbed flange includes an impact reduction zone having multiple deformable ribs located between the first leg and the free end of the ribbed flange.

11. The batten of claim 10 wherein the impact reduction zone has three deformable ribs.

12. The batten of claim 9 wherein the ribbed flange has a width greater than a width of the flat flange.

13. The batten of claim 1 wherein the roof member is one of:

a. an angled truss, b. a wooden roof member, and c. a steel roof member.

14. A method for using a batten, the batten including:

A. a channel having an upside-down U-shaped cross-section, the channel including:

I. a horizontal top,

II. an inclined first leg connected to the horizontal top at a first internal angle, and III. a substantially vertical second leg connected to the horizontal top at a second internal angle, the second leg being shorter than the first leg;

B. a first flange extending horizontally outwardly from an end of the first leg opposite the horizontal top; and C. a second flange extending horizontally outwardly from an end of the second leg opposite the horizontal top;

the method including the steps of:

a. placing the batten on top of a roof member, wherein the roof member extends along a plane oriented at a non-horizontal angle; and b. projecting at least one building anchor through the first flange and into the roof member to connect the roof member and the batten.

15. The batten of claim 14 wherein:

a. the channel is asymmetrical about a vertical axis, b. the first flange is a ribbed flange, and c. the second flange is a flat flange.

16. The method of claim 14 further including the step of orienting the batten atop the roof member such that the substantially vertical leg is located further up the angled roof member before projecting the building anchor.

17. The method of claim 14 wherein the first flange is a ribbed flange including an impact reduction zone having multiple deformable ribs located between the first leg and the free end of the ribbed flange.

18. The method of claim 17 wherein the step of projecting the building anchor through the first flange and into the roof member includes projecting the building anchor through the impact reduction zone such that the building anchor deforms at least one of the multiple deformable ribs.

19. The method of claim 17 wherein the impact reduction zone has three deformable ribs.

20. The method of claim 14 further including the steps of:

a. covering the batten with a roofing material, and b. projecting at least one additional building anchor through the roofing material and into the horizontal top.

21. The method of claim 14 wherein:

a. the first flange is a ribbed flange, and b. the second flange is a flat flange.

22. The method of claim 21 wherein the ribbed flange has a width greater than a width of the flat flange.

23. The method of claim 14 wherein the batten is steel.

24. The method of claim 23 wherein the steel has a gauge thinner than 24 gauge.

25. The method of claim 14 wherein:

a. the first flange has a turn up of at least 90° at its free end, and b. the second flange has a turn up of at least 90° at its free end.

26. The method of claim 14 wherein the batten has:

a. a height of no more than approximately 25 mm, and b. a width of no more than approximately 60 mm.

27. The method of claim 14 wherein:

a. the first internal angle is at least 105°, b. the second internal angle is at least 92°.

* * * * *